United States Patent [19]

McGlashan

[11] 4,307,363

[45] Dec. 22, 1981

[54] PERMEABLE CORRECTOR FOR DEFLECTION YOKES

[75] Inventor: Kenneth W. McGlashan, Lancaster, Pa.

[73] Assignee: RCA Corporation, New York, N.Y.

[21] Appl. No.: 164,344

[22] Filed: Jun. 30, 1980

[51] Int. Cl.[3] ..... H01F 3/12

[52] U.S. Cl. ..... 335/211; 335/210

[58] Field of Search ..... 335/210, 211, 212, 213, 335/214

[56] References Cited

U.S. PATENT DOCUMENTS 4,237,437 12/1980 Vink et al. ..... 335/211

4,257,023 3/1981 Kamijo ..... 335/22

*Primary Examiner*—Harold Broome

*Attorney, Agent, or Firm*—Eguene M. Whitacre; Paul J. Rasmussen; Scott J. Stevens

[57] ABSTRACT

In a color television receiver having an in-line electron beam kinescope and deflection yoke, a correction apparatus comprises a pair of magnetically permeable field formers located on opposite sides of the yoke. A first portion of each field former lies within the external field of the vertical deflection coils and channels flux from the external field into the field formers. A second portion of each field former is configured to form a pair of feet located above and below the longitudinal axis of the kinescope. Flux channelled into the field formers is directed by the feed to form a pincushion-shaped field within the kinescope neck to correct vertical coma errors. A third portion of each field former lies forward of the feet and directs the channelled flux to form a barrel-shaped field within the kinescope neck to correct any misconvergence of the outer electron beams caused by the coma correcting field. In one embodiment, the field formers are coupled to a front crossarm assembly to provide both correction of coma errors and side pincushion distortion.

4 Claims, 7 Drawing Figures

PERMEABLE CORRECTOR FOR DEFLECTION YOKES

This invention relates to correctors for deflection yokes and in particular, to the use of magnetically permeable field formers to correct raster coma error.

Deflection yokes for kinescopes having three horizontal in-line electron beams can be made which substantially converge the three beams at all points on the kinescope display screen without the need for dynamic convergence circuitry. Such self-converging yokes require horizontal deflection coils which produce a negative isotropic astigmatism and vertical deflection coils which produce a positive isotropic astigmatism. Negative isotropic astigmatism is produced by a deflection field which has a predominantly pincushion-shape when viewed in cross section along the axis of electron beam propagation. Positive isotropic astigmatism is produced by a deflection field having a barrel-shaped nonuniformity. A mathematical analysis of the deflection fields using third order aberration theory can be used to determine the deflection field nonuniformity or $H_2$ function for the horizontal and vertical deflection coils. It is this analysis that reveals the nature of the isotropic astigmatism necessary to converge the three electron beams.

Third order aberration theory can also be used to determine the field nonuniformity function necessary to correct coma errors (sized differences between the center-beam raster and the rasters of the outer beams) and raster distortions (e.g. top/bottom pincushion distortion and side pincushion distortion) that can occur with self-converging yokes. It can be shown that coma is most sensitive to correction by a pincushion shaped field at the entrance region of the yoke, while top/bottom and side pincushion distortion is sensitive to correction by a pincushion shaped field in the exit region of the yoke. Third order aberration analysis such as that just described can be found in U.S. Patent Application Ser. No. 070,311, filed Aug. 27, 1979.

In design of a yoke for substantial self-convergence, the horizontal deflection coils, as previously stated, are configured to provide a net negative isotropic astigmatism, such as is provided by a pincushion shaped deflection field. This field shape requirement for self-convergence is consistent with that needed to correct coma and top and bottom pincushion distortion, as previously described. It is therefore relatively easy to manufacture horizontal coils that are essentially coma and pincushion-free. The vertical deflection coils, on the other hand, are required to produce a net positive isotropic astigmatism for convergence, such as is provided by a barrel-shaped field. This barrel-shaped field is inconsistent with the pincushion-shaped field needed for coma and side pincushion correction. Winding the vertical coils with the necessary pincushion-shaped fields needed to provide coma and pincushion correction while still maintaining an overall net barrel-shaped field for convergence of the three electron beams results in requirements for the deflection field nonuniformity function that undesirably increase the sensitivity of convergence to transverse motion of the yoke on the tube neck.

An apparatus for correcting vertical coma errors without the aforesaid increase in convergence sensitivity is disclosed in a copending application of W. H. Barkow and J. Gross, Ser. No. 149,861, filed May 14, 1980 and is also assigned to the present assignee. The Barkow et al. application discloses a pair of external field formers disposed so as to collect stray flux from the vertical deflection coils and channel that flux to the rear of the yoke, where a pincushion-shaped field is formed between the field formers to aid in coma correction. This pincushion field increases deflection of the center beam, therefore enlarging the center beam raster, and tending to correct coma errors of the type where the center beam raster is reduced in height with respect to the outer beam rasters. This supplemental field may also undesirably interact with the outer two beams which may cause misconvergence of the outer beams at the ends of the vertical axis of the raster.

The present invention provides a first supplemental deflection field which provides coma correction but may also cause undesired beam misconvergence. A second supplemental deflection field is therefore provided to compensate for misconvergence caused by the first supplemental field.

In accordance with the present invention, a pair of magnetically permeable field formers are disposed on opposite sides of the yoke within the external stray field of the vertical coils. A part of each field former lies adjacent to the permeable core of the yoke. Flux is channeled into the field formers from the core and the external stray field to an end of each field former disposed adjacent to the kinescope neck in the vicinity of the exit end of the kinescope electron gun assembly. The end of the field formers are configured in such a way that a pincushion field is formed within the kinescope neck for correction of vertical coma errors. Another portion of each field former is disposed in the vicinity of the entrance end of of the yoke and forms a barrel field within the kinescope neck for reducing beam misconvergence caused by the coma-correcting pincushion field. In one illustrative embodiment, the rear field formers are coupled to a pair of front crossarm assemblies for providing both coma and side-pincushion correction.

In the accompanying drawings:

FIG. 6 is a top cross-sectional view of a portion of the arrangement shown in FIG. 5.

Figure 1:
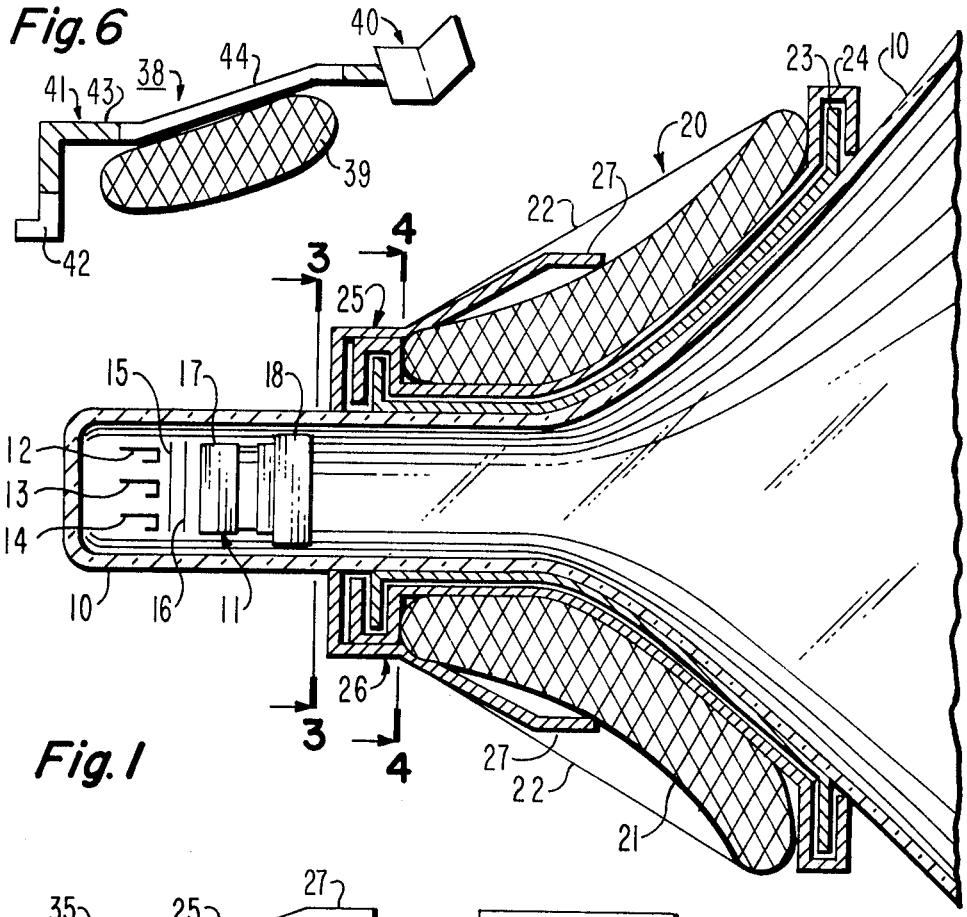
FIG. 1 is a top cross-sectional view of a deflection yoke and kinescope combination embodying the principles of the present invention.

Referring to FIG. 1, there is shown a cross-sectional view of a deflection yoke and kinescope combination comprising a kinescope or picture tube 10. FIG. 1 illustrates neck and funnel regions of kinescope 10. An electron gun assembly 11, comprising three horizontally-aligned cathodes 12, 13 and 14, and accelerating and focussing grids 15, 16, 17 and 18 is disposed within the neck region of kinescope 10. A deflection yoke 20 is mounted on the kinescope 10 in the area where the neck and funnel regions are joined. Deflection yoke 20 comprises a magnetically permeable core 21 generally in the shape of a torus around which is wound the vertical deflection coils 22. These toroidally-wound vertical coils may be of a radial configuration; that is, the plane of the windings passes through the longitudinal axis of the core, or they may be of a nonradial or biased configurature. Bias-wound vertical coils of one configuration may be used to correct side pincushion distortion of the scanned raster. The yoke 20 also comprises saddle-wound horizontal deflection coils 23. The horizontal coils 23 may be made self-converging and free of horizontal coma and NS-pincushion distortion by using a nonradial winding configuration. An insulator 24 separates the vertical coils 22 and the horizontal coils 23.

The yoke 20 also comprises a pair of magnetically permeable field formers 25 and 26 which tend to correct vertical coma errors of the type where the height of the center beam rasters is less than the height of the outer beam raster. It is known that coma errors of this type are subject to correction by a pincushion-shaped field near the entrance of the yoke. Field formers 25 and 26 produce such a pincushion field in the following manner.

Toroidally-wound coils, as opposed to saddle-wound coils, generates a large external stray field outside the core and in front of and behind the yoke. This stray field does not aid in the deflection of the electron beams and represents energy wasted by the yoke. A large amount of magnetic flux is also present in the core 21 itself, induced by the windings 22. A first end 27 of each of field formers 25 and 26 is positioned adjacent to or touching core 21. Flux present in the core is therefore channeled into field formers 25 and 26 by virtue of their high magnetic permeability. Other portions of field formers 25 and 26 are positioned along the core and behind the yoke so as to be within the stray external field. Flux from this stray field is also channeled into field formers 25 and 26. The flux channeled into field formers 25 and 26 is carried to a second end 30 of field formers 25 and 26 which is disposed adjacent to the kinescope neck near the entrance region of the yoke.

Figure 2A:
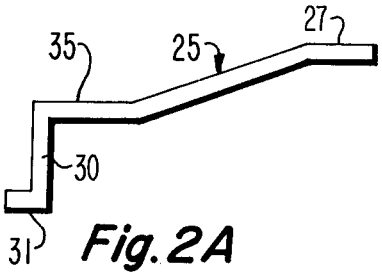
FIGS. 2A and 2B are top and rear views, respectively, of the field formers illustrated in FIG. 1.
Figure 2B:
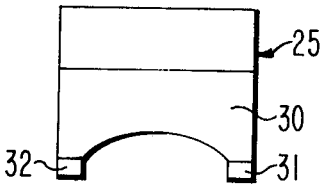
Figure 3:
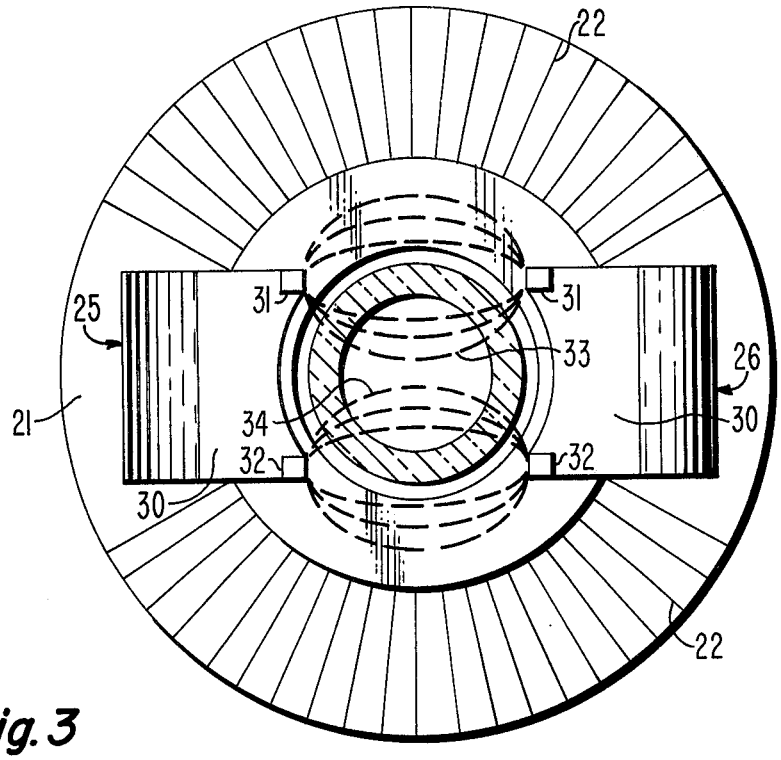
FIG. 3 is a rear cross-sectional view of the yoke and kinescope combination shown in FIG. 1, taken along line 3—3.

FIGS. 2A, 2B and 3 illustrate the shape of representative field former 25 and the location of end 30 with respect to the neck of kinescope 10. The end 30 of field former 25 is shaped so as to embrace a portion of the kinescope neck. End 30 terminates in upper and lower feet 31 and 32, respectively, which extend rearwardly substantially parallel to the tube neck. Flux channeled into field formers 25 and 26 from the core 21 and the external stray field generates a field 33 between corresponding upper feet 31 of field formers 25 and 26 and a field 34 between corresponding lower feet 32 of field formers 25 and 26. Fields 33 and 34, since they begin and end at what could be characterized as point sources, are barrel-shaped. However, a portion of each of fields 33 and 34 falls outside of the neck of kinescope 10, as can be seen in FIG. 3, while the portions of fields 33 and 34 that fall within the kinescope neck combines to form a pincushion-shaped field. This pincushion-shaped field, being localized between feet 31 and 32 in the entrance region of the yoke, tends to correct vertical coma errors by increasing the deflection of the center beam. Since the coma-correcting field is formed from flux channeled from the core and otherwise useless external stray field, the main deflection field is not adversely affected.

Figure 4:
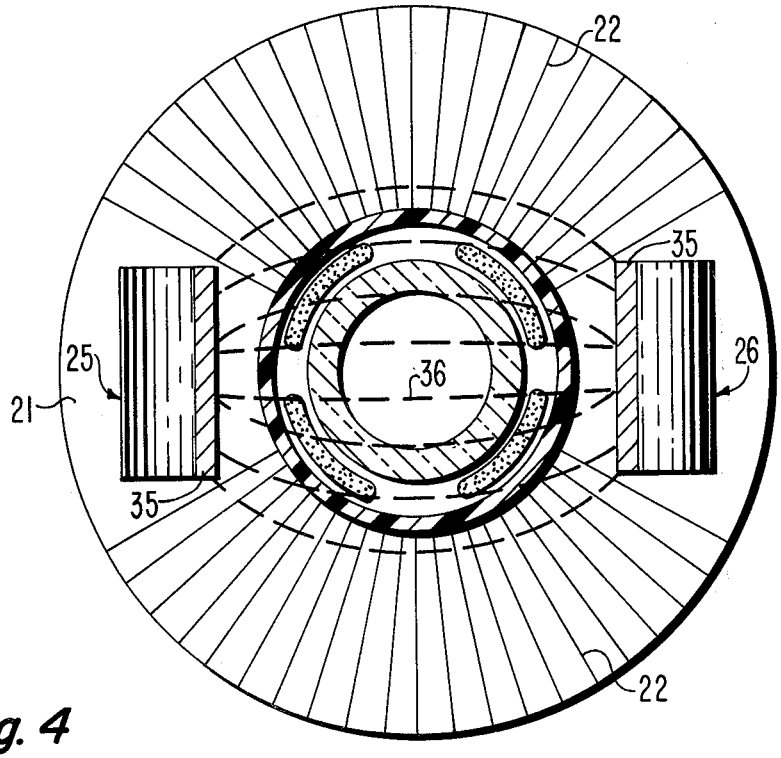
FIG. 4 is a rear cross-sectional view of the yoke and kinescope combination shown in FIG. 1, taken along line 4—4.

One problem that can result from the presence of the coma-correcting pincushion field in the undesirable affect on the outer two beams causing misconvergence at the ends of the vertical axis of the raster. This occurs because the pincushion field used for coma correction reduces the net overall barrel field needed for convergence. Field formers 25 and 26 substantially eliminate this misconvergence problem in the following manner. A portion 35 of field formers 25 and 26 is disposed outside the back of yoke 20 and is substantially parallel to the neck of kinescope 10. Portion 35 is shown in cross section in FIG. 4. The flux channeled in field formers 25 and 26 forms a field 36 between corresponding portions 35 of field formers 25 and 26. Portions 35 act as single sources so that field 36 is essentially barrel-shaped. Barrel field 36 therefore increases the net overall barreling of the deflection field, thereby compensating for the adverse effect on convergence by the pincushion coma-correcting field.

Field formers 25 and 26 therefore correct vertical coma errors without adversely affecting convergence by providing a compensating field to reduce any misconvergence that may be caused by the coma-correcting field.

Figure 5:
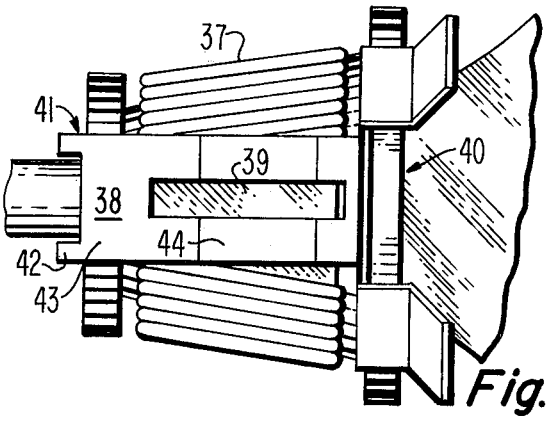
FIG. 5 is a side elevational view of a deflection yoke and kinescope combination, illustrating a particular embodiment of the present invention.

An arrangement for providing a self-converging deflection yoke free of all coma and pincushion distortion is shown in FIG. 5. The yoke shown comprises saddle-wound horizontal coils (not shown) that are configured to provide self-convergence free of horizontal coma and NS-pincushion distortion. The yoke also comprises vertical coils 37 having a radial configuration, toroidally wound about a core 39.

Unitary magnetically permeable field formers 38 disposed on either side of the yoke comprises a front crossarm assembly 40 for providing side-pincushion correction and a rear field-forming assembly 41 comprising pincushion field forming feet 42 and a barrel field forming portion 43 similar to that previously described for providing vertical coma correction without causing misconvergence. A magnetically permeable flux channelling portion 44 lies adjacent to core 39 and channels flux from the vertical coil external field and the core 39 into front crossarm assembly 40 and rear assembly 41. FIG. 6 illustrates the position of one of field former 38 with respect to the core 39. U.K. patent application No. 2,010,005 discloses a front crossarm arrangement used to correct side-pincushion distortion. The position of field formers 38 may be adjusted with respect to the yoke core and tube neck to provide the desired degree of correction. The use of a single field former for both coma and pincushion correction has an advantage that a unitary piece is more efficiently constructed and mounted than separate components. Flux channeling member 44 provides access to a greater amount of otherwise useless flux than would be provided by the use of separate coma and pincushion correctors.

What is claimed is:

1. In a color television display system comprising a kinescope having a neck and means disposed therein for producing a set of three in-line electron beams and a deflection yoke having a magnetically permeable core and disposed forwardly of said beam producing means, said yoke encircling the longitudinal axis of said kinescope neck; a correction apparatus comprising:

a pair of magnetically permeable field formers disposed on opposite sides of said kinescope neck axis, each of said field formers comprising:

a first portion disposed adjacent to the exterior of said magnetically permeable core;

a second portion disposed substantially parallel to said kinescope neck axis and extending rearwardly from said first portion in the vicinity of the beam entrance end of said deflection yoke;

a third portion extending from said second portion in a direction substantially perpendicular to and toward said kinescope neck axis; and a fourth portion comprising a pair of feet extending rearwardly from said third portion, said feet disposed oppositely with respect to said axis and extending substantially parallel thereto, and terminating in the vicinity of the exit end of said beam producing means.

2. The correction apparatus defined in claim 1, wherein said deflection yoke comprises a toroidally-wound vertical deflection coil for producing an internal deflection field and an external field and wherein said field formers are disposed on horizontally opposite sides of said kinescope neck axis, with said field former first portion disposed within said external field and one of said feet of each of said fourth portions disposed above said kinescope neck axis, the other of said feet of each of said fourth portions disposed below said kinescope neck axis.

3. The correction apparatus defined in claim 1, wherein said fourth portions of said field formers form a pincushion-shaped field within a first region of the interior of said kinescope neck and said second portions form a barrel-shaped field within a second region of said kinesope neck disposed forwardly of said first region, the dimensions of said second and fourth portions related so that the net effect on said electron beam set of said pincushion-shaped field and said barrel-shaped field is to increase the deflection of the center beam of said beam set with respect to the outer beams without substantially disturbing the convergence of said outer two beams.

4. In a color television display system comprising a kinescope having a neck and a display screen, an electron gun assembly within said neck for producing three horizontal in-line electron beams including a central beam directed substantially along the longitudinally axis of said neck, and a deflection yoke disposed forwardly of said assembly and having a magnetically permeable core, first deflection coils for deflecting said beam in a horizontal direction, and second deflection coils toroidally-wound about said core and producing an internal field for deflecting said beams in a vertical direction, an external field, and a quantity of magnetic flux within said core; a correction apparatus comprising:

first and second field formers, each of said field formers including:

first magnetically permeable means disposed and extending substantially parallel to said kinescope neck axis in the vicinity of the beam entrance end of said yoke;

second magnetically permeable means magnetically coupled to said first field forming means and disposed parallel to said kinescope neck axis, said second magnetically permeable means comprising a pair of rearwardly extending feet disposed in opposition with respect to said axis and terminating in the vicinity of the beam exit end of said assembly;

third magnetically permeable means disposed at the front of said yoke and comprising field forming crossarms; and fourth magnetically permeable means, disposed within said external field and adjacent said core and coupled between said first and third magnetically permeable means for channeling magnetic flux from said external field and said core into said first, second and third magnetically permeable means; wherein said first and second field formers are disposed in opposition with respect to said neck axis such that said flux is directed by said first magnetically permeable means to form a barrel-shaped field within said kinescope in the vicinity of the beam entrance end of said yoke, and is directed by said second magnetically permeable means to form a pincushion-shaped field within said kinescope neck in the vicinity of the beam exit end of said assembly, and is directed by said third magnetically permeable means to form a pincushion-shaped field within said kinescope in the vicinity of the exit end of said deflection yoke.

* * * * *

UNITED STATES PATENT AND TRADEMARK OFFICE

CERTIFICATE OF CORRECTION

PATENT NO. : 4,307,363

DATED : December 22, 1981

INVENTOR(S) : Kenneth W. McGlashan

It is certified that error appears in the above—identified patent and that said Letters Patent is hereby corrected as shown below:

On The Title Page, in the Abstract, line 11, "feed" should read -- feet --.

Column 6, line 34, after "kinescope" insert -- neck --.

Signed and Sealed this

Sixteenth Day of March 1982

[SEAL]

Attest:

GERALD J. MOSSINGHOFF

Attesting Officer

Commissioner of Patents and Trademarks